US008009112B2

(12) United States Patent
Buer et al.

(10) Patent No.: US 8,009,112 B2
(45) Date of Patent: Aug. 30, 2011

(54) FEED ASSEMBLY FOR DUAL-BAND TRANSMIT-RECEIVE ANTENNA

(75) Inventors: Kenneth V. Buer, Gilbert, AZ (US); Dean Cook, Mesa, AZ (US); Richard Torkington, Mesa, AZ (US); Friedhelm Wachter, Phoenix, AZ (US)

(73) Assignee: ViaSat, Inc., Carlsbad, CA (US)

( * ) Notice: Subject to any disclaimer, the term of this patent is extended or adjusted under 35 U.S.C. 154(b) by 12 days.

(21) Appl. No.: 12/179,430

(22) Filed: Jul. 24, 2008

(65) Prior Publication Data

US 2009/0009404 A1 Jan. 8, 2009

Related U.S. Application Data

(63) Continuation of application No. 10/906,423, filed on Feb. 18, 2005, now abandoned.

(51) Int. Cl.
*H01Q 21/00* (2006.01)

(52) U.S. Cl. ..... 343/725; 343/700 MS; 343/781 R; 343/786; 343/872

(58) Field of Classification Search ..... 343/700 MS, 343/781 R, 786, 872, 725
See application file for complete search history.

(56) References Cited

U.S. PATENT DOCUMENTS

| | | | | |
|---|---|---|---|---|
| 5,041,840 | A | 8/1991 | Cipolla et al. | |
| 5,334,990 | A | 8/1994 | Robinson | |
| 5,341,141 | A * | 8/1994 | Frazier et al. | 342/59 |
| 6,060,961 | A | 5/2000 | Moheb et al. | |
| 6,081,235 | A * | 6/2000 | Romanofsky et al. | 343/700 MS |
| 6,084,921 | A | 7/2000 | Cronin | |
| 6,114,998 | A * | 9/2000 | Schefte et al. | 343/700 MS |
| 6,329,957 | B1 | 12/2001 | Shea et al. | |
| 6,362,788 | B1 | 3/2002 | Louzir | |
| 6,384,787 | B1 * | 5/2002 | Kim et al. | 343/700 MS |
| 6,396,441 | B2 * | 5/2002 | Perrott et al. | 343/700 MS |
| 6,512,485 | B2 * | 1/2003 | Luly et al. | 343/781 CA |
| 6,529,098 | B2 | 3/2003 | Moheb | |
| 6,642,889 | B1 * | 11/2003 | McGrath | 343/700 MS |
| 6,714,165 | B2 | 3/2004 | Verstraeten | |
| 6,720,933 | B2 | 4/2004 | Hanlin et al. | |
| 7,161,537 | B2 | 1/2007 | Rafi et al. | |
| 2002/0005806 | A1 | 1/2002 | Perrott et al. | |
| 2003/0122723 | A1 | 7/2003 | Luly et al. | |
| 2004/0021614 | A1 | 2/2004 | Moheb | |
| 2006/0035588 | A1 | 2/2006 | Chapelle | |
| 2006/0189273 | A1 | 8/2006 | Buer et al. | |

FOREIGN PATENT DOCUMENTS

| | | |
|---|---|---|
| FR | 2821489 | 8/2002 |
| JP | 60018004 | 1/1985 |

OTHER PUBLICATIONS

International Search Report dated May 30, 2006.
International Preliminary Report on Patentability dated Aug. 30, 2007.
Office Action dated Sep. 26, 2007 in parent application.
Office Action dated Mar. 25, 2008 in parent application.
Advisory Action dated Jun. 26, 2008 in parent application.

* cited by examiner

*Primary Examiner* — Jacob Y Choi
*Assistant Examiner* — Shawn Buchanan
(74) *Attorney, Agent, or Firm* — Snell & Wilmer L.L.P.

(57) ABSTRACT

A Ka/Ku-band transmitter-receiver comprises a tri-band feed of a Ka-band transceiver, in conjunction with an array of phase combined patch receiving, antennas that operate at the Ku-band frequencies.

8 Claims, 5 Drawing Sheets

FEED ASSEMBLY FOR DUAL-BAND TRANSMIT-RECEIVE ANTENNA

CROSS REFERENCE TO RELATED APPLICATIONS

This application is a continuation of patent application having Ser. No. 10/906,423 filed Feb. 18, 2005 now abandoned entitled "SYSTEMS, METHODS AND DEVICES FOR A KU/KA BAND TRANSMITTER-RECEIVER", and which is hereby incorporated by reference.

FIELD OF INVENTION

The field of the invention generally relates to a satellite transmitting and receiving unit and more particularly, to systems, methods and devices for a Ka-band transmitter-receiver configured to operate in conjunction with a Ku-band receiver.

BACKGROUND OF THE INVENTION

With the expansion of telecommunications, wireless technology, and various information systems, a greater number of operational frequencies are needed to meet expected demand. The Ka-band is a relatively newly released satellite transmission frequency, deployed to accommodate this growing demand. It is assigned to a frequency range from about 20 GHz to about 30 GHz, wherein the reception occurs at about 20 GHz and the transmission occurs at about 30 GHz.

Ku-band is a relatively standardized satellite transmission frequency and has been one of the standards used for some time. It operates in about the 12 GHz range. One disadvantage with the Ku-band frequencies is that it is becoming less and less available as demand continues to soar in the telecommunications arena, i.e. the available usable frequencies are diminishing. It should be appreciated though that future technology will not merely dispense with the "aging" frequency because many systems will still rely on the Ku-band long into the future.

It is anticipated in the near future that a number of Ka-band satellites will be launched. A primary purpose for the dissemination of these Ka-band satellites is to provide, for example, broadband data services to homes and small businesses as well as address the growing limitations on the Ku-band frequencies, as mentioned above. A number of service providers actively developing this broadband service offering, have defined a need for a low cost, efficient ground terminal that can be used for a Ka-band service and at the same time may receive standard Fixed Satellite Service (FSS) and Direct Broadcast Satellite (DBS) Services operating in the International Telecommunications Union (ITU) defined Ku-band spectrum. This dual Ka-band receiving/transmitting functions along with the Ku-band receiving function is more generally referred to as a tri-band configuration.

At this time a number of technical solutions are under development or are being proposed, and most approaches do not meet the aggressive cost targets because of the prohibitive nature in developing units that operate to receive and transmit Ka-band satellite signals and also receive Ku-band signals. In one example, a co-axial feed comprising a feed horn is used as the solution to the tri-band configuration and is described by the Raytheon Company's, U.S. Pat. No. 6,720,933. However, the configuration disclosed in Raytheon's patent requires very tight and precise tolerances. These tolerance requirements make the unit cost prohibitive in a mass marketing scheme, i.e. to be able to provide the units to the general public at a low cost.

Another example, described by the U.S. Pat. No. 6,512,485 and assigned to WildBlue Communications, Inc., describes a tri-band reflector that encompasses a dichroic subreflector. In essence, the dichroic subreflector allows certain frequencies to filter through while reflecting others. Such a configuration allows the lower Ku-band frequency to pass through while reflecting the higher frequency Ka-band signals. However, this invention is also subject to very tight and precise manufacturing tolerances. Therefore the Wild Blue embodiments are also somewhat cost prohibitive in nature on a mass marketing level.

In still another example, some manufacturers attempt to utilize certain characteristics of folded optics to assemble a combination Ka-band/Ku-band transmitter-receiver. In general folded optics incorporate dual reflecting dishes and may also take into account the benefit of dual focal points. This also technology suffers from the same limitations as the above mentioned art. That is, the technology requires significant precision and tight tolerances that are generally too expensive to incorporate into a mass produced product that is attempting to satisfy the needs of a general public.

Therefore, a need exists for a low cost ground terminal configured to transmit or receive Ka-band satellite signals to provide, for example, broadband data services to homes and businesses, and at the same time, be able to receive standard FSS and DBS Services operating in the ITU defined Ku-band spectrum.

SUMMARY OF THE INVENTION

While the way in which the present invention addresses the disadvantages of the prior art will be discussed in greater detail below, in general, the present invention provides for a Ka-band transmitter-receiver that operates in conjunction with a Ku-band receiver that can offer significant advantages to the user, which the prior art does not address.

For example, in accordance with various embodiments of the present invention, a tri-band feed comprises a commonly available dielectric loaded Ka-band transmit/receive feed and an array of phase combined, patch receiving antennas operating at the Ku-band frequencies.

BRIEF DESCRIPTION OF THE DRAWINGS

The subject matter of the present invention is particularly pointed out and distinctly claimed in the concluding portion of the specification. A more complete understanding of the present invention, however, may best be obtained by referring to the detailed description and claims in connection with the drawing figures, wherein:

DETAILED DESCRIPTION

The following description is of various exemplary embodiments of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth in the appended claims. For example, in the context of the present invention the apparatus hereof finds particular use in connection with a circular array of a number of Ku band receiving patch antennas surrounding a Ka-band receiver-transmitter system. However, generally speaking, other configurations of the Ku/Ka-band transmitter-receivers may be suitable for use in accordance with the present invention.

Figure 1:
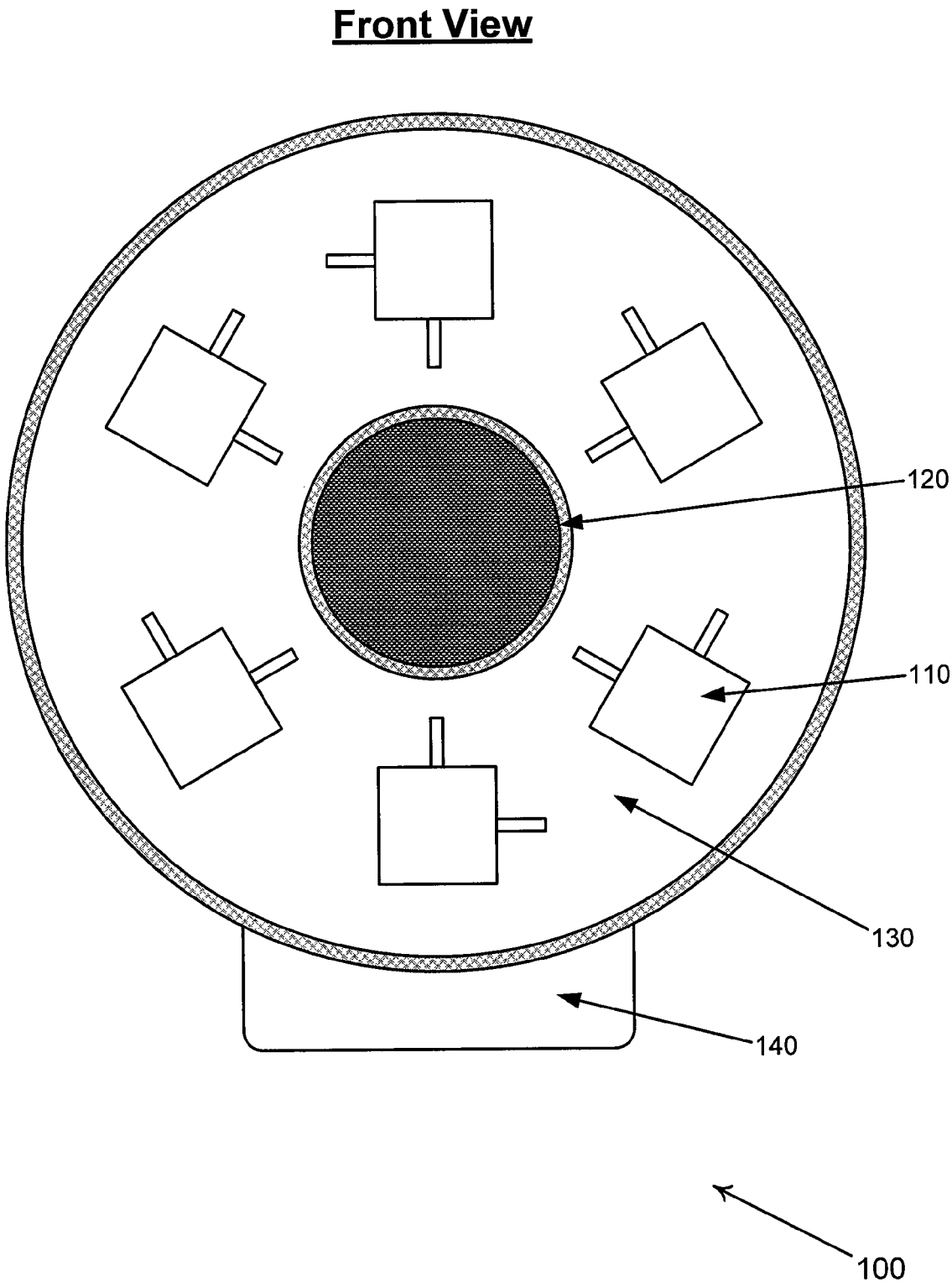
FIG. 1 illustrates a front view of a Ka-band transmitter-receiver amidst a circular array of Ku-band patch receiving antenna elements, in accordance with an exemplary embodiment of the present invention.

In an exemplary embodiment of the present invention and with reference to FIG. 1, tri-band system 100 comprises a circular array of patch antennas 110, configured to be properly oriented and/or phase aligned to receive a Ku-band transmission. In the middle of the circular array of patch antennas 110, tri-band system 100 may also be configured to incorporate a Ka-band transmitter-receiver 120. Tri-band system 100 may also comprise a Ku-band low noise block (LNB) 140.

Figure 2:
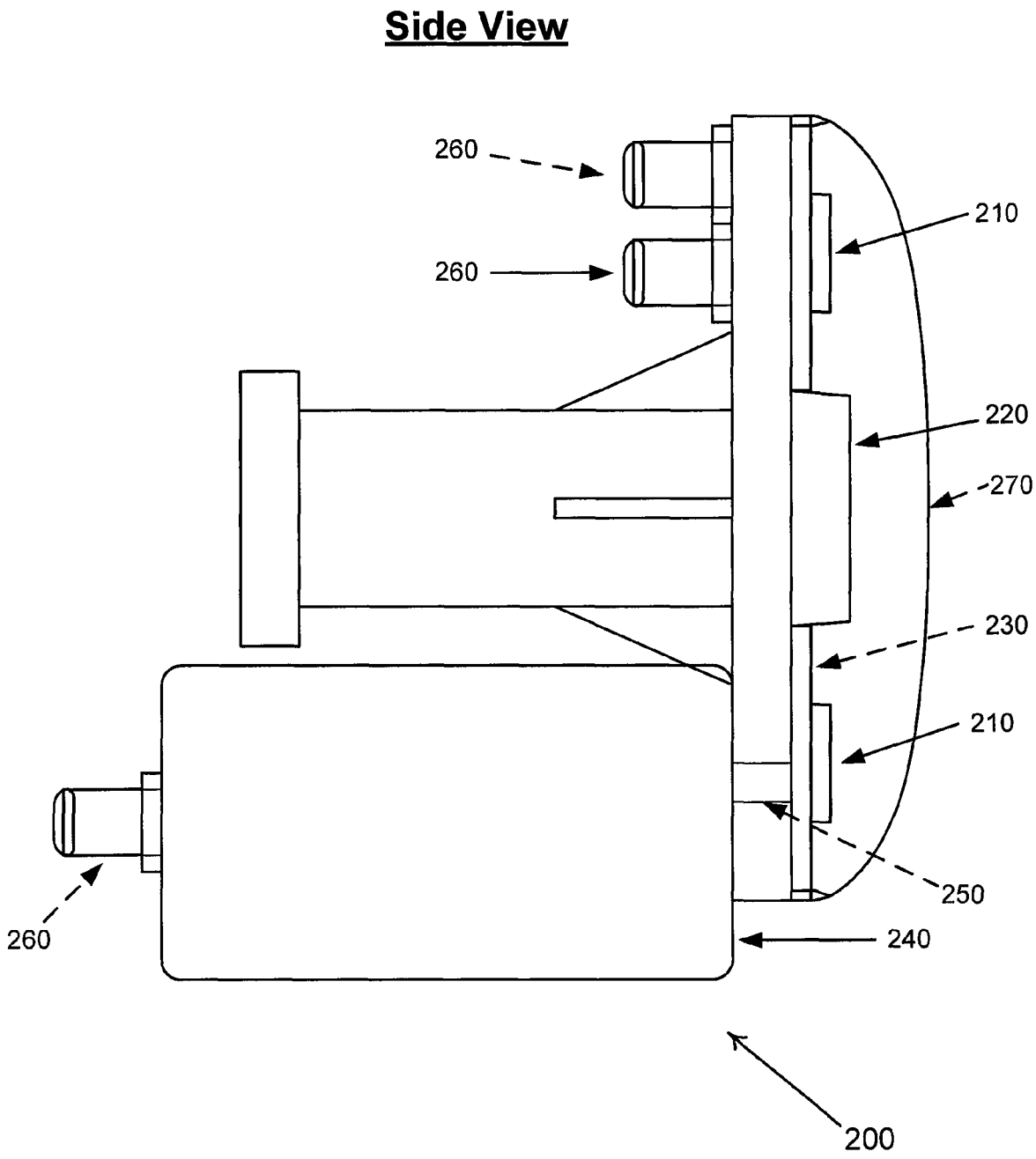
FIG. 2 illustrates a side view of a tri-feed Ka/Ku-band transmitter-receiver unit, in accordance with an exemplary embodiment of the present invention.

In an exemplary embodiment and with reference to FIG. 2, tri-band antenna system 200 comprises, as briefly mentioned above, a number of Ku-band patch antennas 210, in combination with a Ka-band receiver-transmitter. Tri-band system 200 may also comprise other electronic elements to support the tri-band system. For example, system 200 may comprise a Ku-band low noise block (LNB) 240, a Ku-band printed wire board (PWB) 230, a low noise amplifier (LNA) not shown, an interconnect 260, and/or a protective cover 270.

Ku-band patch receiving antenna 210 is generally configured to receive a transmission signal within the Ka-band signal range, and can comprise any configuration to that purpose, now known or herein after devised. In one aspect, patch antenna 210 comprises a square conductor mounted adjacent to a ground plate. The dimensions of the square may be roughly ½ the receiving wavelength. For example, if the operating frequency of a satellite is 12.2 GHz then half of a wavelength is about $(3.0\times10^{8}/1.22\times10^{10})*0.5$ and the resulting dimension is approximately 12 mm. The insulating space between the square conductor and the ground plate may be air. In one exemplary embodiment of the present invention, other exemplary patch antennas may also comprise a Teflon based dielectric circuit board material with a slightly higher dielectric constant. The slightly higher dielectric constant allows the patch to be slightly smaller. One exemplary circuit board may comprise RO4003, manufactured by the Rogers Corporation.

Continuing with FIG. 1, the pattern and/or configuration of patch antennas 110 may be configured to improve reception of the Ku-band signal. For example, the array of antenna elements may be arranged to provide adequate antenna gain and reduce unwanted sidelobe (off axis) gain. Additionally, the placement and spacing of the patch elements may be optimized using electromagnetic field simulators, in accordance with standard phased array antenna design methods. However, it should be appreciated that patch antennas 110 may be configured in any geometric fashion that allows a Ku-band signal to be received. The patches are affixed, in one exemplary embodiment, to printed wiring board (PWB) 130, which is sometimes referred to as a printed circuit board (PCB).

As briefly mentioned above, tri-band system 100 may comprise PWB 130. PWB 130 may further be a base to which electronic components may be affixed. PWB 130 may be formed of various materials, such as: fiberglass (glass epoxy), paper epoxy, bakelite plastic, and/or the like material. The boards are typically drilled with 0.8 mm holes at 0.1 inch (2.54 mm) intervals. This hole pattern may completely cover the boards from edge to edge. On one side of the boards and centered around each hole is usually a copper layered "land" or "pad." As components, such as patch antennas 110, are placed upon the board, opposite the copper layered side, the components leads are placed through the holes and the wires soldered. In one aspect, the copper layering may be pre-soldered (tinned) to make soldering easier.

With reference to FIG. 2, in an exemplary embodiment, PWB 230 may comprise one or more low-noise amplifiers (LNA's). The LNA may be configured to optimize noise figure performance by providing an input matching circuit between the element and the LNA device. The LNA's may be configured to amplify a signal received by patch antennas 210, without adding significant excess noise. By doing so, the remaining electronic components may manipulate the enhanced signal for subsequent use. Several suitable LNA devices are commercially available. One example of a suitable LNA device is a NE3210, manufactured by the NRC Corporation. It should be appreciated that other components comparable to a NE3210 device may be used to enhance a signal.

As the Ku-band signal is received by the patch array, the patches may be oriented and/or phase aligned. The signal is then directed to a Ku-band Low Noise Block (LNB) 240 sometimes referred to as a Low Noise Block Down converter. One example of a LNB is a US Monolithics part, part number USMLNBKu6DLF02154. One purpose of LNB 240 may be, for example, to amplify and covert the received signal to a lower frequency. For example, Ku-band patch receivers 110 may receive a signal within approximately the 12 GHz range; however, this frequency may be too high for subsequent processing and use by the other electronic components. Thus, LNB down converter 240 may convert the signal to a more usable frequency. Although described herein as a LNB, other types of components may be configured to provide amplification and frequency conversion. In another example, other suitable low cost mixers and local oscillators may be used for this application.

In an exemplary embodiment of the present invention, the tri-band unit may comprise connectors 260 to connect an indoor unit to Ka-band transmitter 220. Connectors 260 may also comprise a connection from Ka-band and Ku-band LNB's 240 to an indoor unit. Connectors 260 provide a conduit for the signals between tri-band unit 200 and an indoor operating unit, not shown. In one aspect of the present invention, standard co-axial cables, not shown, are used to connect, for example, an "F" connect 260 to an appropriate indoor unit. An "F" connect may be used because of its low cost and because it is well known in the art of cable TV. Although connector 260 may be described herein as an "F" connect, other types of connectors may be used. For example, other types of suitable connectors may comprise an "N" connector, an "SMA," or any other suitable RF connector.

As briefly mentioned above, and returning to FIG. 1, in an exemplary embodiment tri-band unit 100 may comprise a combination Ka-band transmitter/receiver (Ka-transceiver) 120. Ka-transceiver 120 may be configured to be situated within the center of the circular array of Ku-band patch antennas 110, best viewed by FIG. 1. In one exemplary embodiment Ka-band transceiver 120 may also comprise a LNA and/or a LNB to provide a similar function as the LNA and LNB of Ku-band patch antenna 110. In one example, a commercial Ka-band transceiver 120 comprises US Monolithics part, part number TXR29303W.

Figure 3:
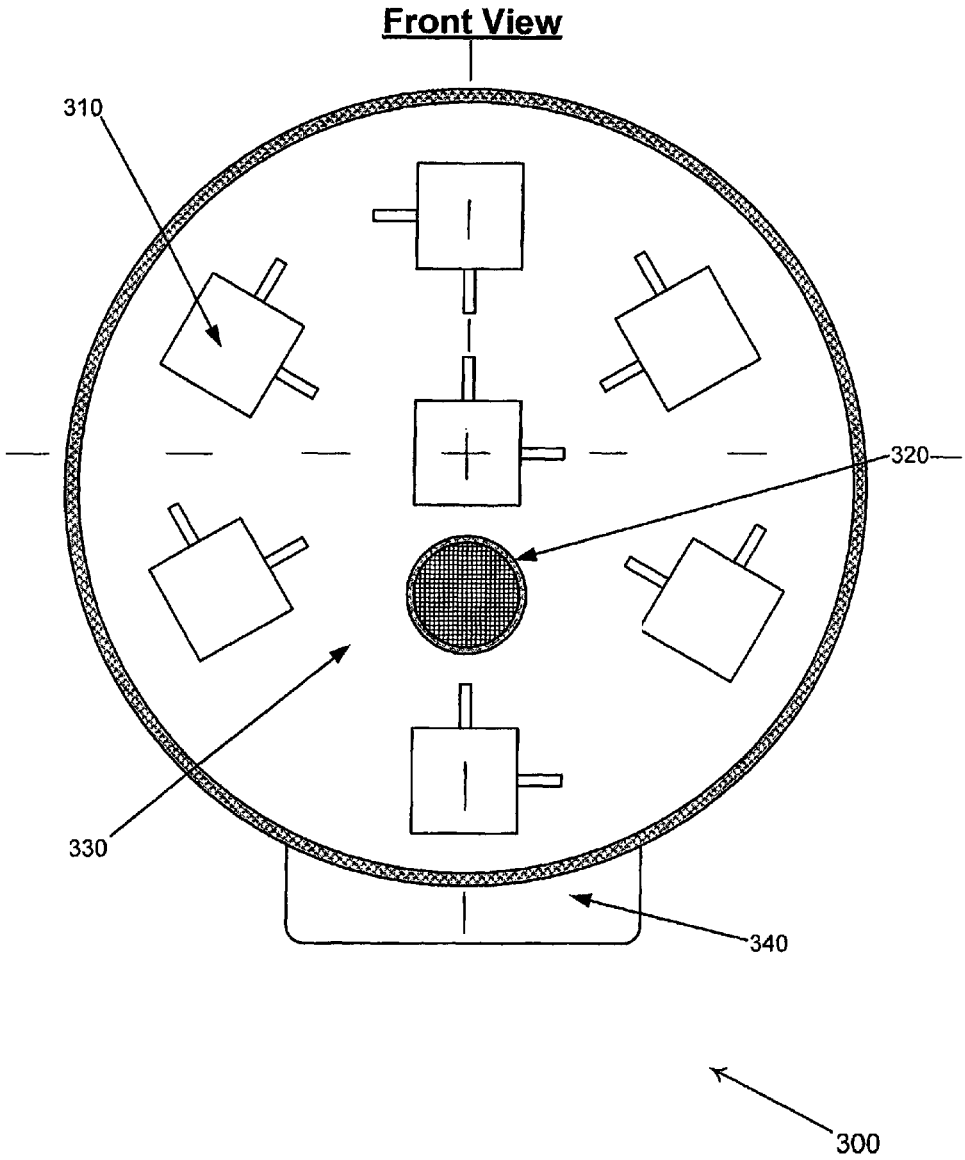
FIG. 3 illustrates an exemplary embodiment of the present invention depicting the patch pattern with a center patch and an off center phase steered Ku-band receiver.

In an exemplary embodiment, and with reference to FIG. 3, a tri-band antenna system 300 comprises a number of Ku-band patch antennas 310, a Ka-band feed horn 320, a printed wire board (PWB) 330, and a Ku-band low noise block (LNB) 340.

Figure 4:
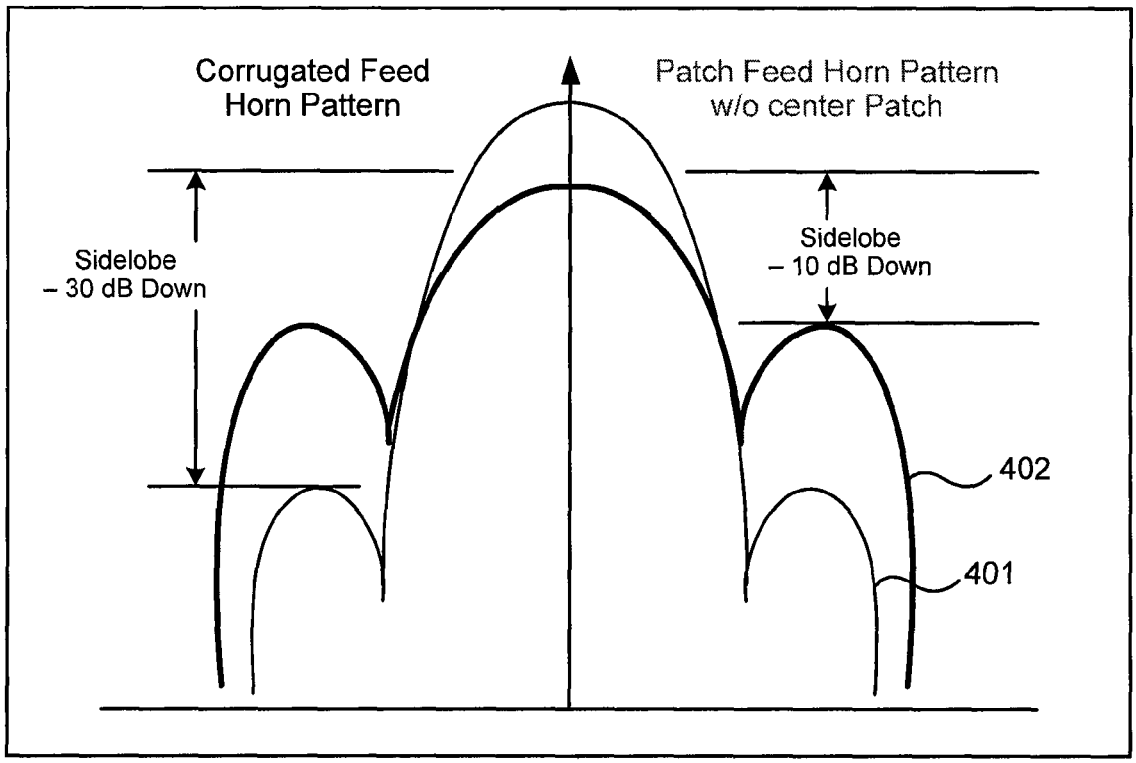
FIG. 4 illustrates an exemplary graph depicting the differences in gain between a patch array without a center patch and a patch array with a center patch, in accordance with an exemplary embodiment of the present invention.
Figure 5:
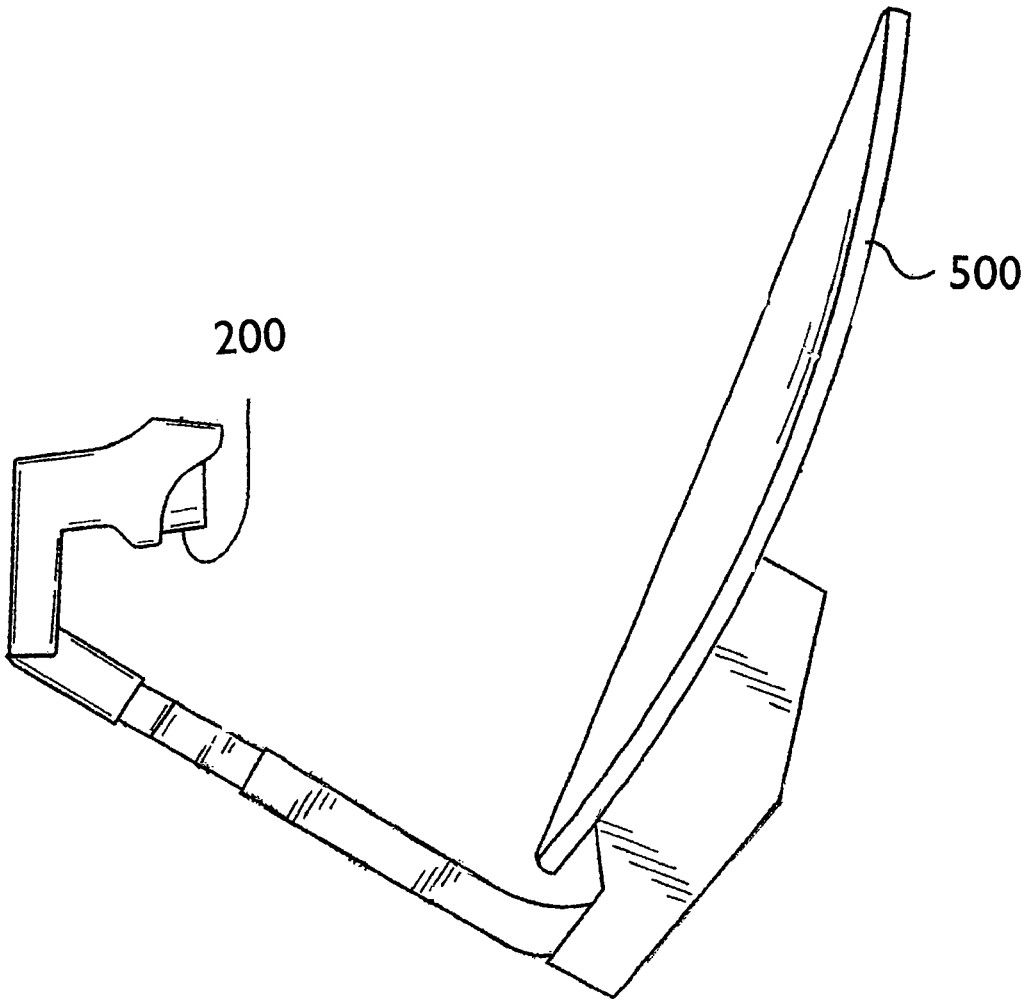
FIG. 5 illustrates in schematic form an exemplary reflector dish in accordance with an exemplary embodiment of the present invention.

In another exemplary embodiment of the present invention, and best seen in FIG. 3, Ka-band transceiver 320 may be off center from the circular array of patch antennas 310. In this embodiment, tri-band system may further comprise an additional patch antenna that occupies the center position. In this manner, Ku-band patch receivers 310 may operate at a higher efficiency than an array of patch antennas without a center patch. For example, and with reference to FIG. 4, a graph depicting the gain from a Ku-band receiver with a center patch and one without a center patch is shown. The graph indicates that the gain is higher for a configuration that incorporates a patch array containing a center patch rather than an array without a center patch. The graph also demonstrates that the side lobes are significantly lower for the array containing a center patch (curve 401) than an array without a center patch (curve 402).

Continuing with off center Ka-band transceiver 320, the signals are received and transmitted from the off-center feed horn by designing the horn to radiate energy in a slightly asymmetric fashion thereby still illuminating the reflector evenly. This is also known as "beam steering." This configuration allows Ku-band transceiver 320 to incorporate a "center" patch antenna and thus improve Ku-band signal reception without degrading the Ka-band antenna performance.

In an exemplary embodiment of the present invention, with momentary reference to FIG. 2, tri-band unit 200 may comprise a cover to protect the unit. During use, tri-band unit 200 may be configured to be installed in an outside environment to receive overhead satellite transmissions. As such, unit 200, and especially the electronic components, is subject to damage by the environment, such as, rain, snow, sleet, hail, smog, UV rays, etc. In general, to protect unit 200 from such adverse elements, cover 270 may comprise a plastic, for example a polycarbonate, to use for the covered protection. In an exemplary embodiment, the plastic cover generally comprises a highly durable material to protect the components from the natural elements as well as any harmful UV waves. Cover 270 may be hemispherical in nature and comprised to not interfere with either the reception or transmission of signals. In addition, a thermoset, thermoplastic, composite, or the like material that can reasonably protect the unit from the elements may also be contemplated by the present invention. Moreover, while in an exemplary embodiment, cover 270 is hemispherical in nature, it may comprise other geometric configurations that still allow tri-band unit 200 to operate effectively, but also protect unit 200 from the elements.

In an exemplary embodiment of the present invention, and with reference to FIGS. 1 and 3, tri-band unit 100 comprises any configuration that allows Ku-band receiving patch antennas 110 to be configured in combination with Ka-band transceiver 120. For example, the herein described exemplary embodiments discuss a circular array of Ku-band patch antennas 110 with a center occupying Ka-band transceiver 120. Another embodiment discusses a circular array of patch antennas 310 with a center patch antenna and an off center Ka-band transceiver 320. However, other configurations may exist that operate in a similar fashion, and take advantage of Ku-band receiving patch antennas 310 in combination with Ka-band transceiver 320. Patch antennas 310 may comprise other geometric configurations, for example, hexagonal, octagonal, rectangular, pentagonal, and the like shapes. In still another configuration, Ka-band transceiver 320 may comprise something other than a centered or off-centered configuration. For example, Ka-band transceiver 320 may be located along the perimeter of the unit, be attached tangentially to the unit, or be inside or outside a geometric array of patch antennas 310.

Lastly, various principles of the invention have been described in illustrative embodiments. However, many combinations and modifications of the above-described structures, arrangements, proportions, elements, materials and components, used in the practice of the invention, in addition to those not specifically described, may be varied and particularly adapted to specific environments and operating requirements without departing from those principles.

We claim:

1. An antenna device for transmitting and receiving satellite signals comprising:

a feed horn antenna configured to transmit signals in a Ka-band at a first frequency and also configured to receive signals in a Ka-band at a second frequency that is not equal to the first frequency, wherein said first frequency is higher than said second frequency by about 10 GHz, and wherein said feed horn antenna is a non-coaxial horn; and a plurality of Ku-band patch antennas configured to receive Ku-band frequencies, wherein said plurality of Ku-band patch antennas are arranged in an array, wherein each of said plurality of Ku-band patch antennas are located an equal distance from a central point, and wherein said feed horn antenna is positioned off center and within the arranged array of said plurality of Ku-band patch antennas so as to radiate energy in a slightly asymmetric fashion while still illuminating a reflector evenly.

2. The antenna device of claim 1, wherein the signals that are transmitted or received via said feed horn antenna are phase adjusted for optimum transmission or reception.

3. An antenna system configured to transmit and receive signals wherein said antenna system comprises both a plurality of Ku-band patch antennas and a Ka-band feed horn; wherein said plurality of Ku-band patch antennas comprise a circular array of patch antennas; wherein said plurality of Ku-band patch antennas and said Ka-band feed horn are focused at a common reflector; wherein said plurality of Ku-band patch antennas comprise a circular array of patch antennas and a patch antenna centered within said circular array of patch antennas; wherein said Ka-band feed horn is positioned off center within said circular array of patch antennas so as to radiate energy in a slightly asymmetric fashion while still illuminating said common reflector evenly, and wherein said Ka-band feed horn is a non-coaxial horn.

4. A multi-band feed assembly for transmitting and receiving radio frequency signals comprising:

a feed horn configured to send a first Ka-band signal and receive a second Ka-band signal, wherein said first Ka-band signal is at a significantly higher frequency than said second Ka-band signal, and wherein said feed horn is a non-coaxial horn;

an array of patch antennas in a concentric pattern around said feed horn, said array of patch antennas configured to receive a Ku-band signal; and wherein said feed horn and said array of patch antennas are focused at a common reflector, and wherein said feed horn is positioned off center and within said array of patch antennas so as to radiate energy in a slightly asymmetric fashion while still illuminating a reflector evenly.

5. The multi-band feed assembly of claim 4, further comprising a cover to protect said feed horn and said array of patch antennas.

6. A multi-band feed assembly comprising:

a first feed comprising a feed horn, wherein said feed horn is configured to transmit signals in a Ka-band at a first frequency and also configured to receive signals in a Ka-band at a second frequency that is not equal to the first frequency, wherein said first frequency is higher than said second frequency by about 10 GHz, and wherein said feed horn is a non-coaxial horn; and a second feed comprising an array of Ku-band patch antennas around said feed horn;

wherein said array of Ku-band patch antennas and said feed horn are affixed to a common base, wherein said common base further comprises a printed wiring board;

wherein said first feed and said second feed are configured to share a common reflector;

wherein said multi-band feed assembly does not comprise a dichroic subreflector; and wherein said feed horn is positioned off center of said array of Ku-band patch antennas so as to radiate energy in a slightly asymmetric fashion while still illuminating said common reflector evenly.

7. The multi-band feed assembly of claim 6, wherein said feed horn and said array of Ku-band patch antennas are orientated in a common direction.

8. A multi-band feed assembly comprising:

a reflector;

a feed horn having an electrical aperture, wherein said feed horn is a non-coaxial horn;

an array of patch antennas surrounding said feed horn;

wherein said feed horn is located such that said electrical aperture is at a focal point of said reflector; and wherein said feed horn transmits a first Ka-band signal to and receives a second Ka-band signal, of different frequency than said first Ka-band signal, from said electrical aperture at said focal point of said reflector, wherein said feed horn is a non-coaxial horn, wherein said array of patch antennas receives a Ku-band signal from virtually the same location as said focal point of said reflector, and wherein said feed horn is positioned off center and within said array of patch antennas so as to radiate energy in a slightly asymmetric fashion while still illuminating said reflector evenly.

* * * * *